US006913014B2

(12) United States Patent
Chiang

(10) Patent No.: US 6,913,014 B2
(45) Date of Patent: Jul. 5, 2005

(54) SMOKE GUIDE STRUCTURE FOR KITCHEN HOOD

(76) Inventor: Pi-Tang Chiang, No. 172-10, Chung Cheng Rd., Shang Feng Village, Tai Ya Hsian, Taichung Hsien (TW)

( * ) Notice: Subject to any disclaimer, the term of this patent is extended or adjusted under 35 U.S.C. 154(b) by 0 days.

(21) Appl. No.: 10/364,355

(22) Filed: Feb. 12, 2003

(65) Prior Publication Data

US 2004/0154612 A1 Aug. 12, 2004

(51) Int. Cl.[7] ..... F24C 15/20
(52) U.S. Cl. ..... 126/299 R; 126/299 D
(58) Field of Search ..... 126/299 R, 299 D, 126/299 E, 300; 55/DIG. 36; 454/341, 349, 354

(56) References Cited

U.S. PATENT DOCUMENTS 3,628,311 A * 12/1971 Costarella et al. ..... 96/228
5,228,428 A * 7/1993 Jang ..... 126/299 D
5,537,988 A * 7/1996 Lin ..... 126/299 D
5,718,219 A * 2/1998 Boudreault ..... 126/299 E
5,904,751 A * 5/1999 Van Niekerk ..... 95/212

* cited by examiner

*Primary Examiner*—James C. Yeung
(74) *Attorney, Agent, or Firm*—Browdy and Neimark, P.L.L.C.

(57) ABSTRACT

A smoke guide structure used in a kitchen hood having a housing, an air buffer with an air inlet and an air outlet provided inside the housing, and a fan and fan motor assembly provided inside the air buffer and adapted to draw off smoke produced during cooking is disclosed to include an outer shell mounted inside the housing, an inner shell mounted inside the outer shell, an air path defined between the outer shell and the inner shell and connected to the air inlet of the air buffer, and a grease trap fastened to an orifice of the air path and adapted to accumulate waste grease produced in the air path.

12 Claims, 7 Drawing Sheets

SMOKE GUIDE STRUCTURE FOR KITCHEN HOOD

BACKGROUND OF THE INVENTION

1. Field of the Invention

The present invention relates generally to kitchen hoods, and more particularly to the smoke guide structure for kitchen hood.

2. Description of the Related Art

A regular kitchen hood 1, as shown in FIG. 1, has two circular smoke inlets 2 and 3 for sucking in smoke produced during cooking. Because smoke produced during cooking does not flow vertically upwards toward the smoke inlets 2 and 3, a part of the smoke dissipates without entering the smoke inlets 2 and 3.

In order to eliminate the aforesaid problem, high-efficiency kitchen hoods have been continuously developed. Taiwan Utility Model Patent Publication No. 36912, entitled "Improved structure of smoke guide for kitchen hood", uses a wind guide to change the angle of the smoke path, and to further achieve the object of reducing the production of noises and smoothening the air path. Taiwan Utility Model Patent Publication No. 376141, entitled "Improved structure of kitchen hood", teaches the use of a plurality of safety smoke suction hoods and at least one smoke accumulating pipe for collecting smoke. In the aforesaid two utility models, the extended smoke path enhances the smoke expelling efficiency of the kitchen hood. However, these designs provide no means to accumulate waste grease produced in the smoke path. When waste grease produced in the smoke path after a long use of the kitchen hood, it flows along the peripheral wall of the smoke path and then drops from the bottom side of the kitchen hood to contaminate the cooking food or the area in the kitchen.

Therefore, it is desirable to have a smoke guide structure for kitchen hood that eliminates the aforesaid problem.

SUMMARY OF THE INVENTION

The present invention has been accomplished under the circumstances in view. It is therefore the main object of the present invention to provide a smoke guide structure, which enables waste smoke to be effectively expelled to the outside of the kitchen and, prevents a leakage of waste grease.

It is another object of the present invention to provide a smoke guide structure, which fits any of a variety of kitchen hoods.

To achieve these objects of the present invention, the smoke guide structure comprises an outer shell mounted inside a housing of the kitchen hood, an inner shell mounted inside the outer shell, an air path defined between the outer shell and the inner shell and connected to an air inlet of an air buffer of the kitchen hood, and a grease trap fastened to an orifice of the air path and adapted to accumulate waste grease produced in the air path. The inner shell accumulates smoke produced during cooking, enabling accumulated smoke to be sucked into the air buffer through the air path and then quickly expelled to the outside of the kitchen subject to the operation of a fan and fan motor assembly in the air buffer of the kitchen hood. Waste grease produced in the air path during cooking flows along the peripheral wall of the air path to the grease trap, preventing a leakage of waste grease.

DETAILED DESCRIPTION OF THE INVENTION

Figure 1:
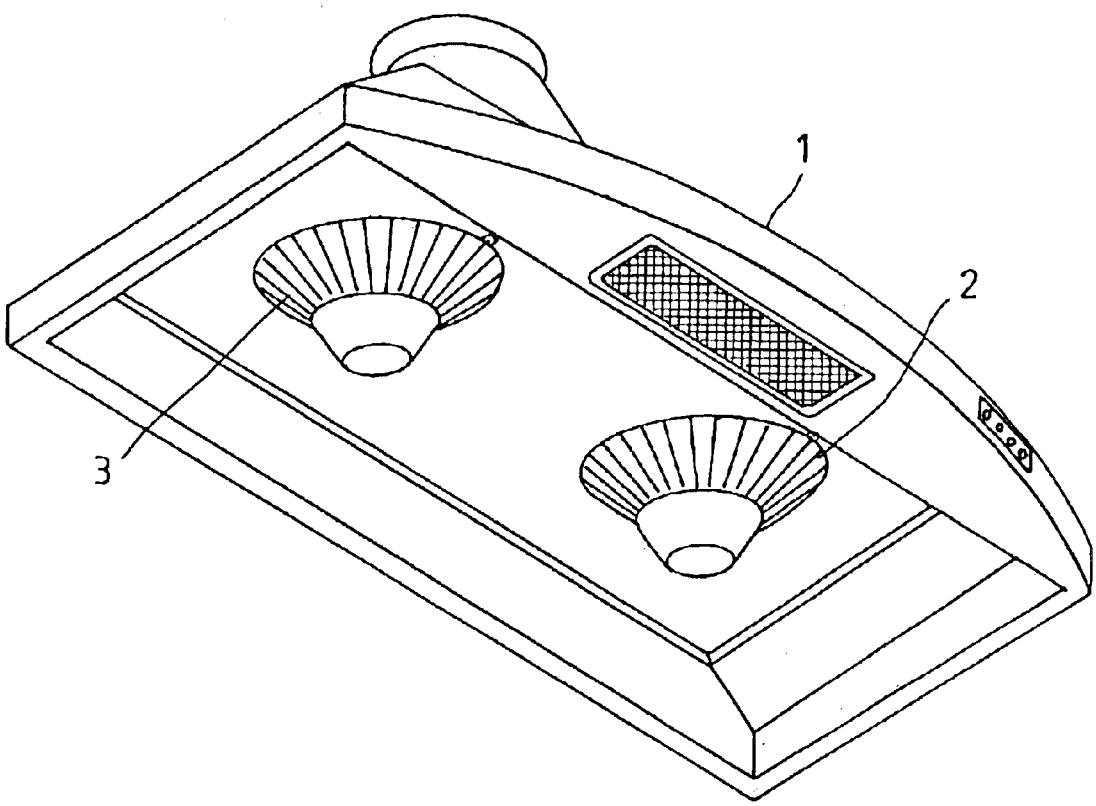
FIG. 1 PRIOR ART
FIG. 1 is a schematic drawing showing the structure of a conventional kitchen hood.
Figure 2:
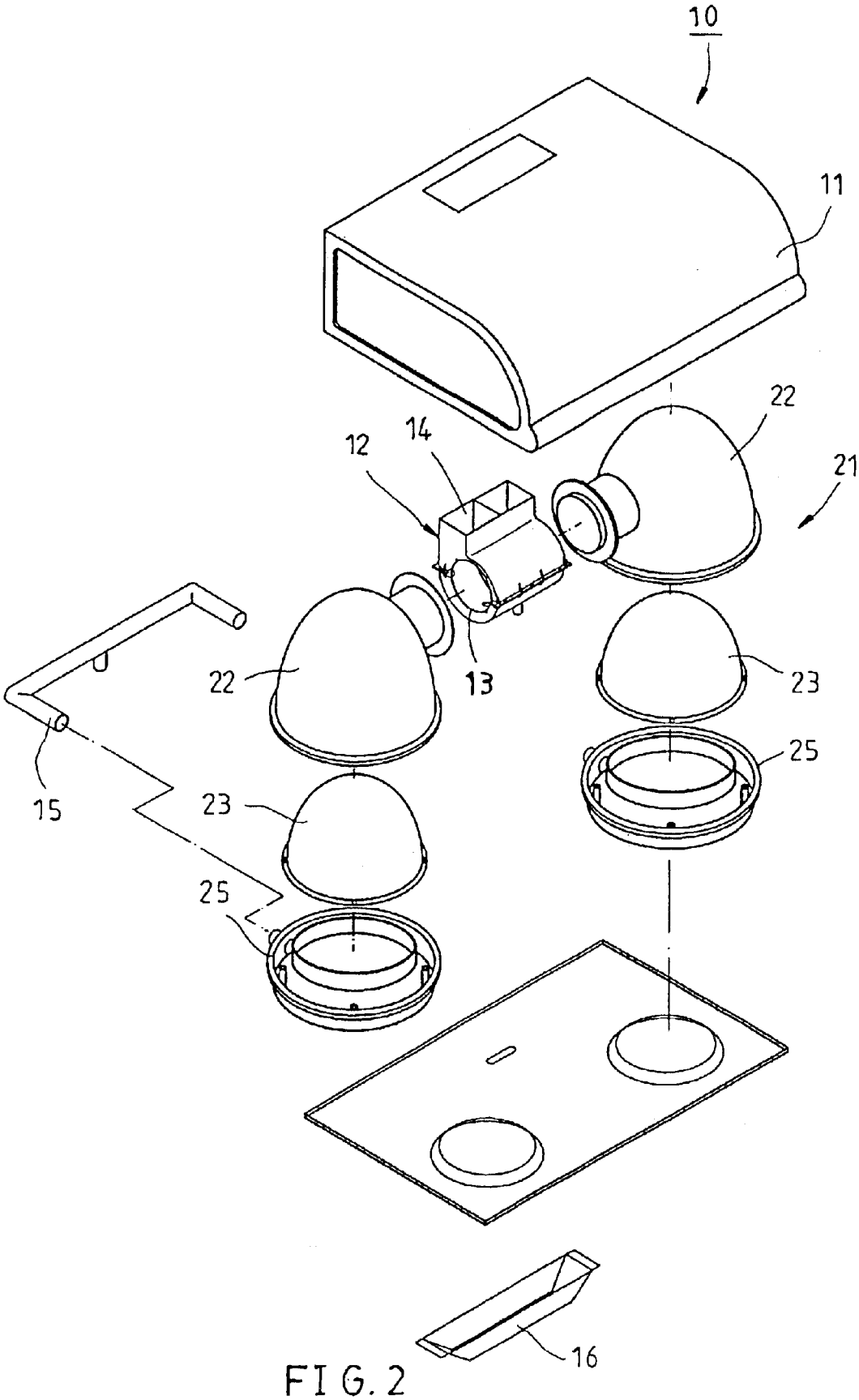
FIG. 2 is an exploded view of a first preferred embodiment of the present invention.
Figure 3:
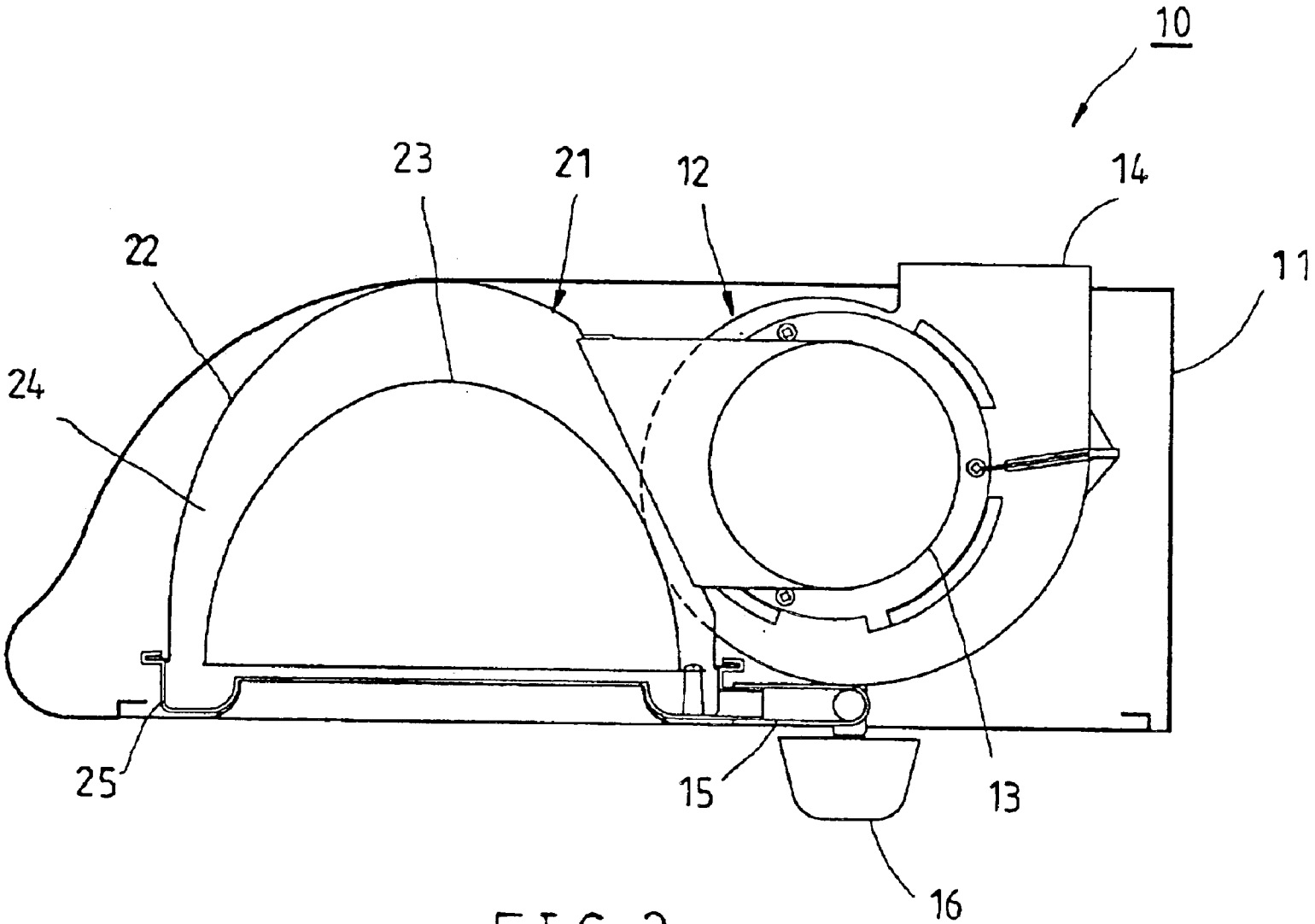
FIG. 3 is a side view in section of the first preferred embodiment of the present invention.
Figure 4:
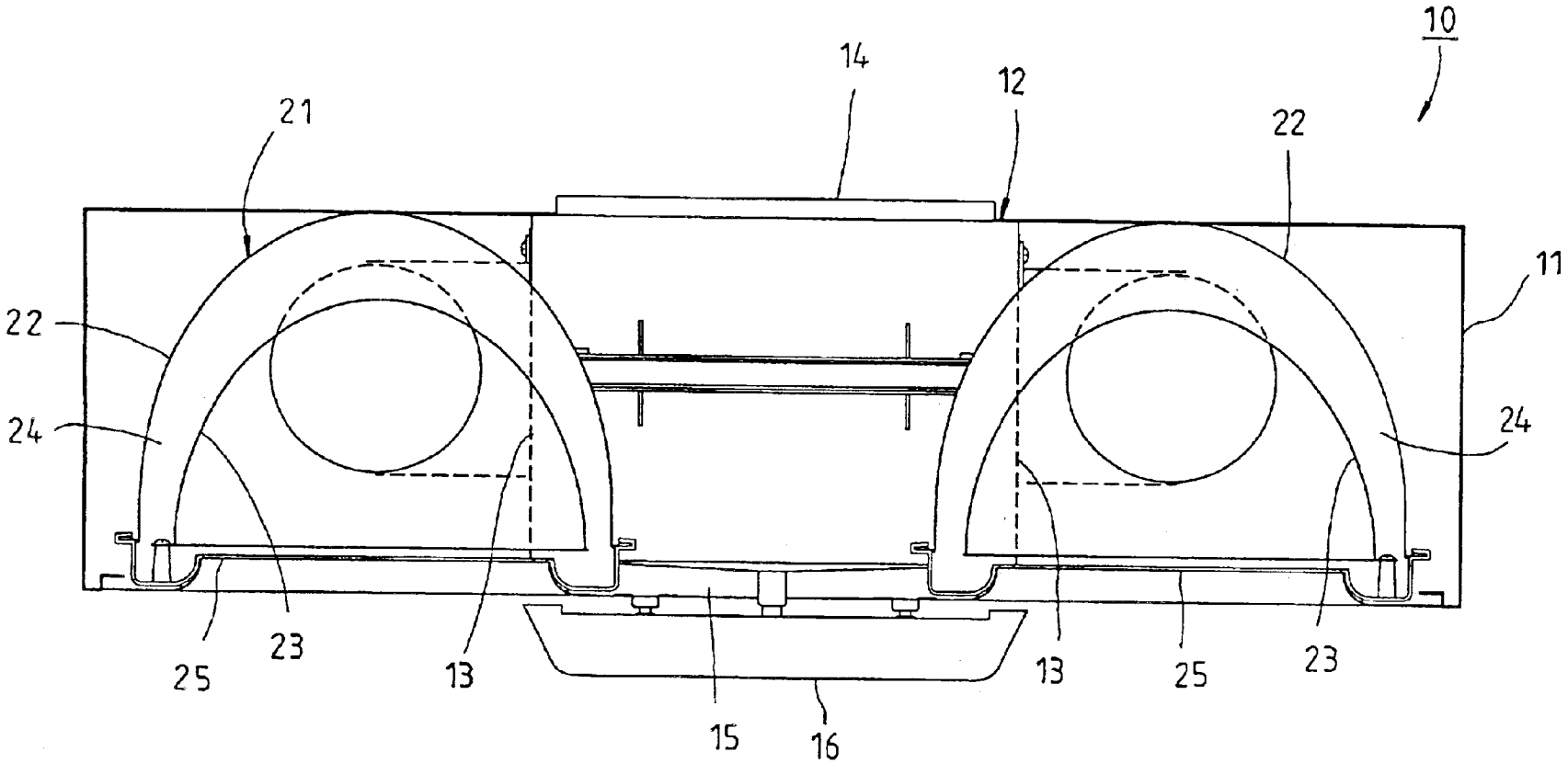
FIG. 4 is a front view in section of the first preferred embodiment of the present invention.

As shown in FIGS. 2–4, a kitchen hood 10 is shown comprising a housing 11, an air buffer 12 provided inside the housing 11, the air buffer 12 having an air inlet 13 and an air outlet 14, a fan and a fan motor (not shown) provided inside the air buffer 12 and operated to draw off smoke produced during cooking, and at least one, for example, two smoke guides 21 adapted to guide smoke produced during cooking into the air inlet 13. The smoke guides 21 each are comprised of an outer shell 22, an inner shell 23, and a grease trap 25.

The outer shell 22 is a smoothly arched hollow shell mounted inside the housing 11. The inner shell 23 is substantially similar to the shape of the outer shell 22 and mounted inside the outer shell 22, defining with the outer shell 22 a air path 24 in air communication with the air inlet 13 of the air buffer 12 for enabling the air inside the air path 24 to be expelled to the outside through the air outlet 14 of the air buffer 12 subject to the action of the fan and fan motor in the air buffer 12. The grease trap 25 has a shape designed subject to the orifice of the air path 24, and is detachably fastened to the orifice of the air path 24 to collect waste grease flowing out of the air path 24. The detachable design of the grease trap 25 facilitates the maintenance work.

As indicated, the air path 24 of each smoke guide 21 is in communication with the air inlet 13 of the air buffer 12 of the kitchen hood 10. During cooking, produced smoke flows through the air path 24 to the outside of the kitchen hook 10 via the air outlet 14 of the air buffer 12, and at the same time waste grease produced in the air path 24 flows along the peripheral wall of the air path 24 to the grease trap 25. Further, a grease tube 15 is used to guide waste grease from the grease trap 25 to a collector cup 16. Therefore, the kitchen hood 10 effectively and rapidly expels smoke during cooking, and prevents a leakage of waste grease.

Figure 5:
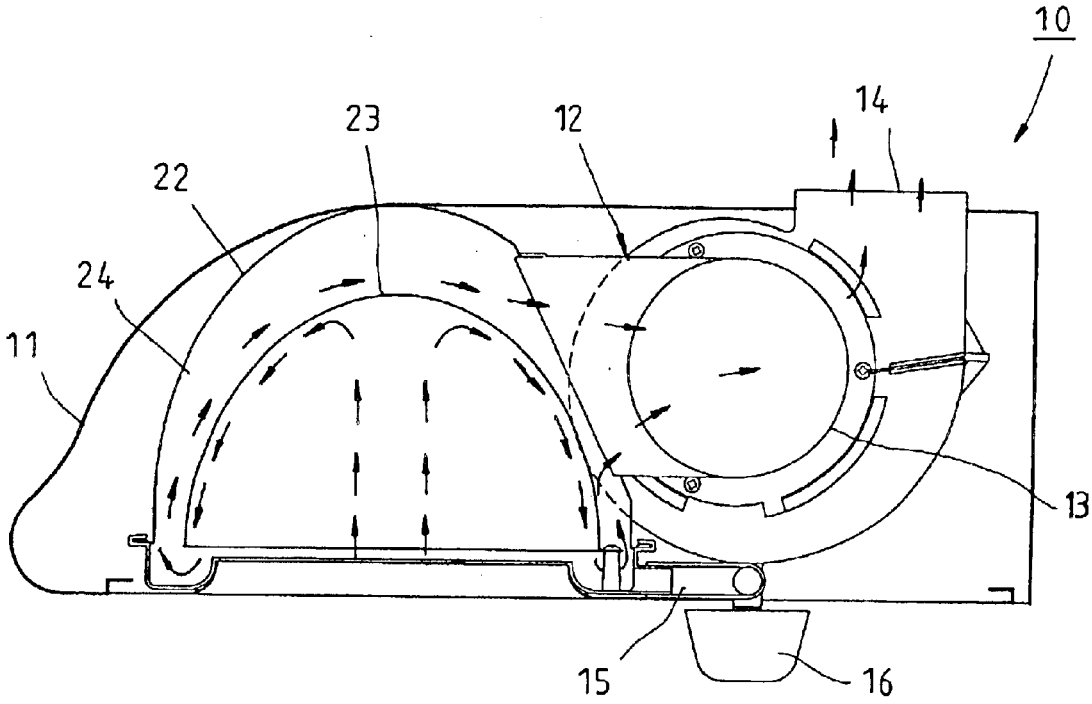
FIG. 5 is a schematic drawing showing the smoke flowing direction in the first preferred embodiment of the present invention.

With reference to FIG. 5, when smoke rises during cooking, the smoothly arched inside wall of the inner shell 23 forms a smoke accumulation chamber to accumulate smoke, preventing a return of smoke and, enabling accumulated smoke to be quickly sucked through the air path 24 into the air inlet 13 of the air buffer 12 and then expelled to the outside of the kitchen hood 10 through the air outlet 14 subject to the action of the fan motor and the fan in the air buffer 12.

Figure 6:
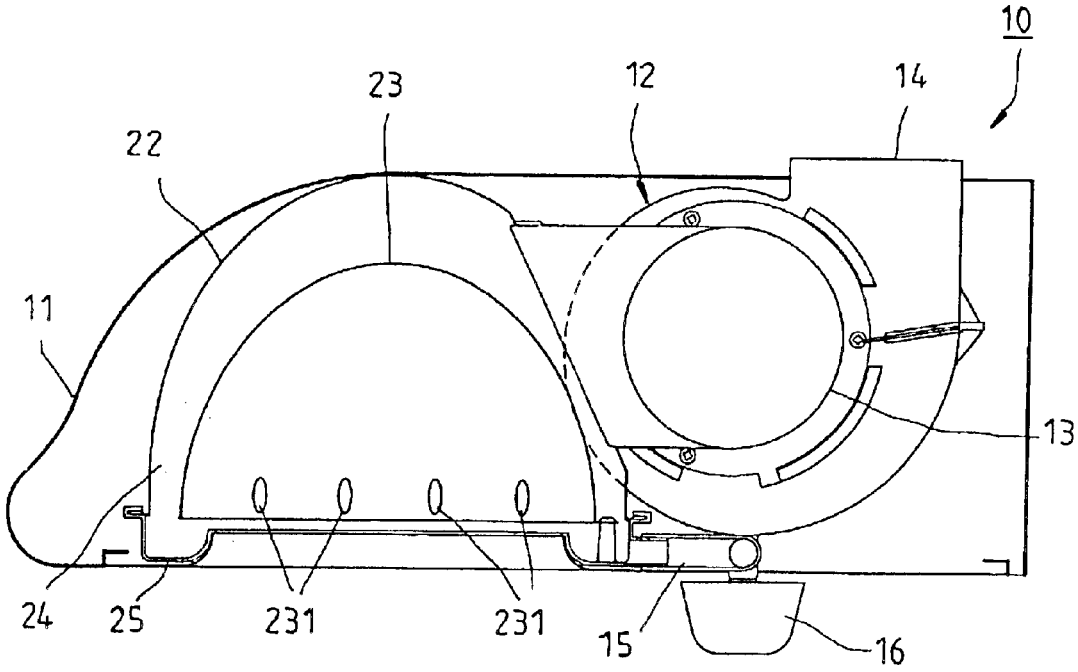
FIG. 6 is a side view in section of a second preferred embodiment of the present showing oval air vents arranged in the inner shell.

With reference to FIG. 6, the inner shell 23 has a plurality of oval air vents 231 radially arranged near the bottom edge in communication with the air path 24 for quick dissipation of smoke. When waste grease flowing out of the air path 24 through the air vents 231, it drops to the grease trap 25 below the inner shell 23, preventing a leakage of waste grease.

Figure 7:
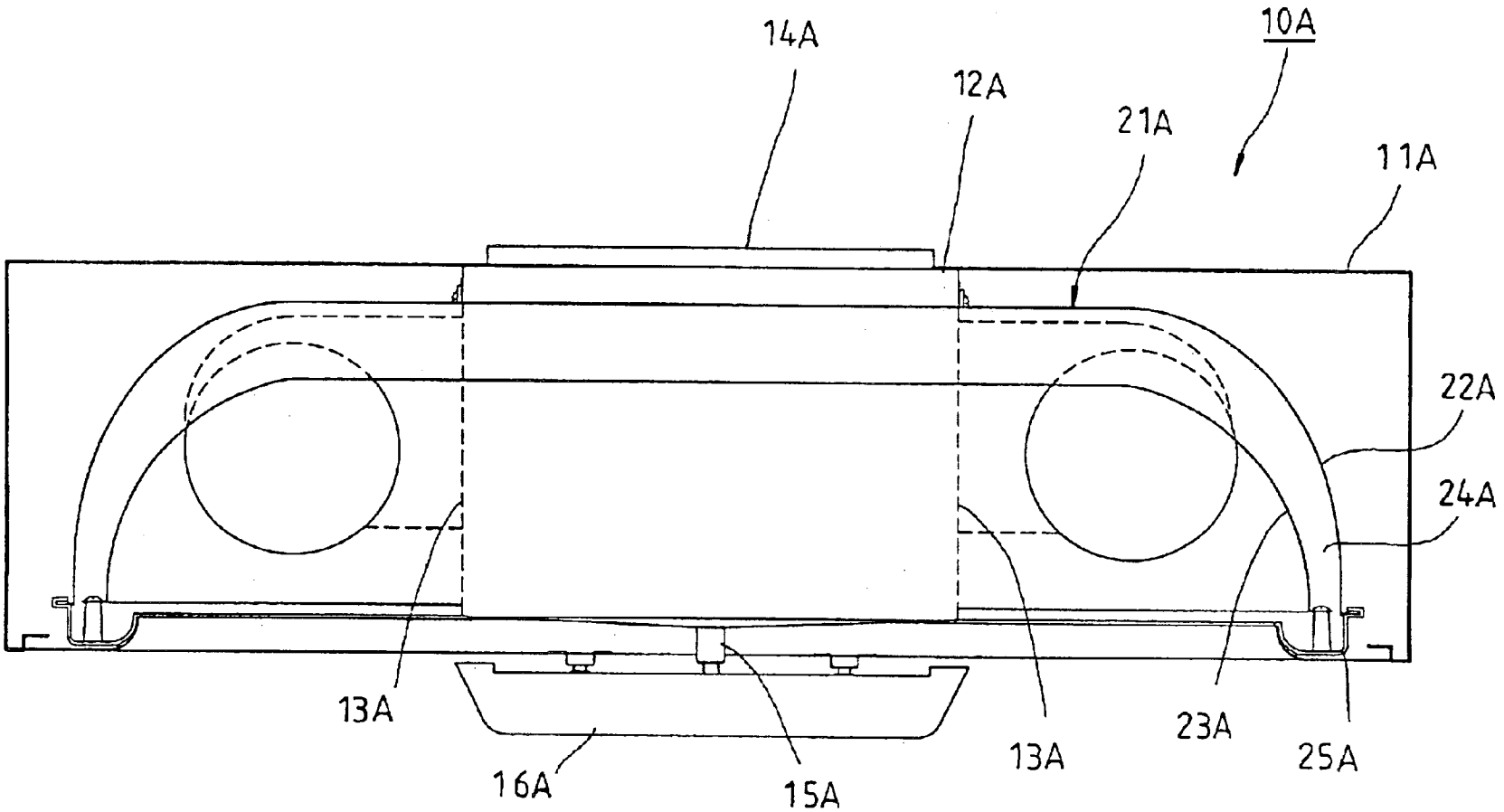
FIG. 7 is a sectional assembly view of a third preferred embodiment of the present invention.
Figure 8:
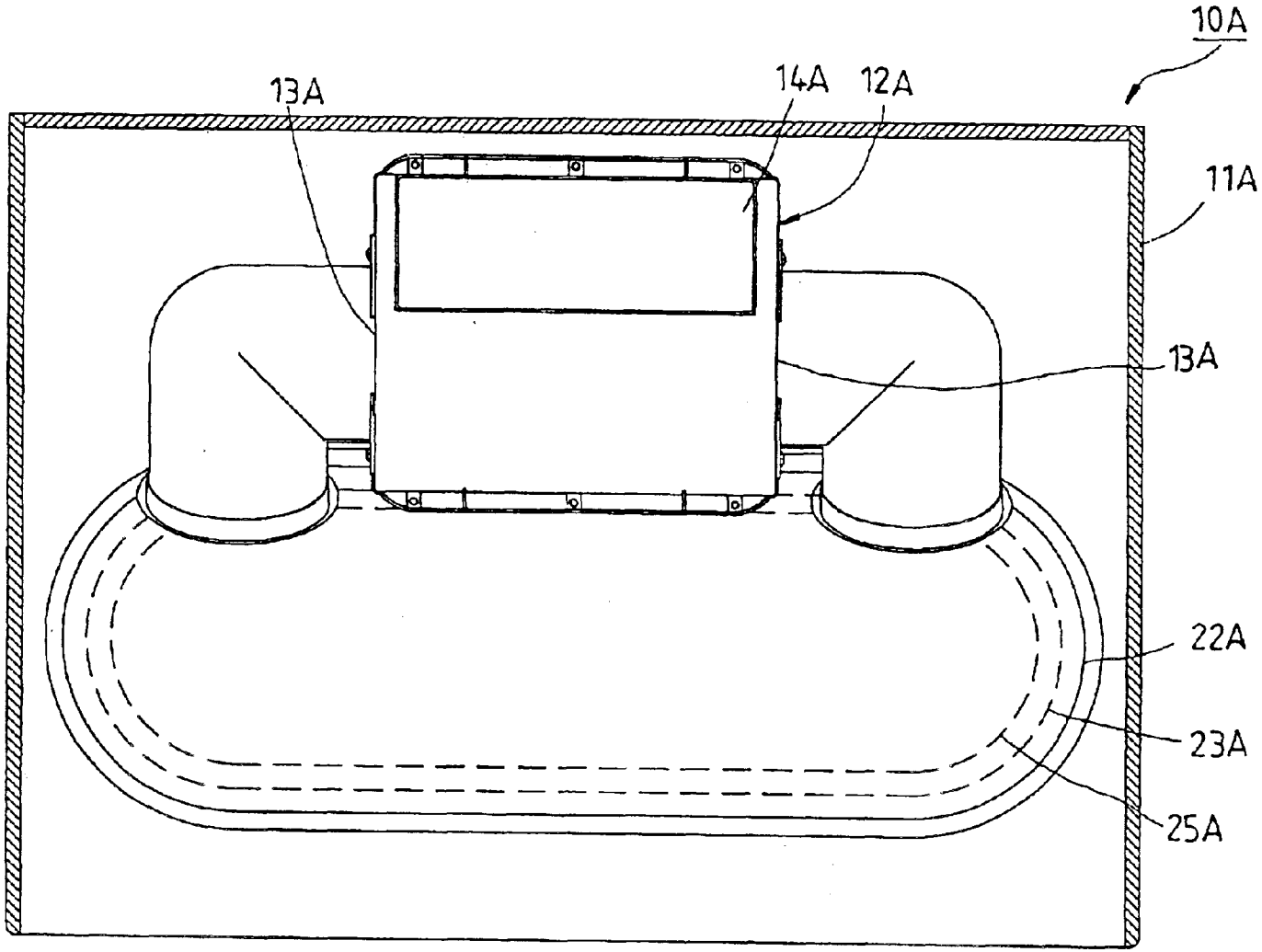
FIG. 8 is a top view in section of the third preferred embodiment of the present invention.

FIGS. 7 and 8 show an alternate form of the present invention. According to this alternate form, only one smoke guide 21A is provided inside the kitchen hood 10A. The grease trap 25A has a hollow, oval shape fitting the orifice of the air path 24A defined between the outer shell 22A and the inner shell 23A. This alternate form achieves the same effects, i.e., air return free and grease leakage free.

The aforesaid outer shell 22 and inner shell 23 can be made by die-casting. Alternately, multiple metal sheet members may be used and assembled to form the outer shell 22 and the inner shell 23.

As indicated above, the invention has the advantages as follows:

1. Air return free: when smoke rising during cooking, the smoke accumulation chamber inside the inner shell accumulates produced smoke, enabling produced smoke to be quickly and completely expelled to the outside subject to the action of the fan and fan motor in the air buffer.

2. Grease leakage free: when waste grease produced in the air path after a long use of the kitchen hood, it flows along the peripheral wall of the air path to the inside of the grease trap, preventing a leakage.

3. High applicability: the smoke guide structure can be used in any of a variety of conventional kitchen hoods.

What is claimed is:

1. A smoke guide structure used in a kitchen hood having a housing, an air buffer provided inside said housing and having an air inlet and an air outlet, and a fan and a fan motor provided inside said air buffer and adapted to draw off smoke from a cooking area produced during cooking, the smoke guide structure comprising:

an outer shell open in a direction facing the cooking area mounted inside said housing;

a hollow inner shell open only in a direction facing the cooking area and mounted inside and spaced apart from said outer shell to define with said outer shell an air path therebetween, said air path being connected to said air inlet of said air buffer through an outlet in the outer shell and having an orifice, a grease trap detachably fastened below said orifice of said air path and adapted to accumulate waste grease produced in said air path, and wherein outer peripheral edges of the open outer and inner shells are located directly over the grease trap.

2. The smoke guide structure as claimed in claim 1, wherein said grease trap has a profile fitting the shape of the orifice of said air path.

3. The smoke guide structure as claimed in claim 1 further comprising a grease collector cup, and a grease tube connected between said grease trap and said grease collector cup and adapted to guide accumulated waste grease from said grease trap to said grease collector cap.

4. The smoke guide structure as claimed in claim 1, wherein said inner shell has a plurality of air vents radially arranged near a bottom edge thereof in air communication with said air path.

5. The smoke guide structure as claimed in claim 1, wherein said inner shell and said outer shell are respectively made as a smooth arched hollow unit.

6. The smoke guide structure as claimed in claim 1, wherein said inner shell and said outer shell are respectively formed of a plurality of metal sheet members.

7. A smoke guide structure used in a kitchen hood having a housing, an air buffer provided inside said housing and having an air inlet and an air outlet, and a fan and a fan motor provided inside said air buffer and adapted to draw off smoke produced during cooking, the smoke guide structure comprising:

an outer shell mounted inside said housing;

an inner shell mounted inside said outer shell and defined with said outer shell an air path therebetween, said air path being connected to said air inlet of said air buffer and having an orifice, a grease trap fastened to said orifice of said air path and adapted to accumulate waste grease produced in said air path, and wherein said inner shell has a plurality of air vents radially arranged near a bottom edge thereof in air communication with said air path.

8. The smoke guide structure as claimed in claim 7, wherein said grease trap is detachable from the orifice of said air path.

9. The smoke guide structure as claimed in claim 8, wherein said grease trap has a profile fitting the shape of the orifice of said air path.

10. The smoke guide structure as claimed in claim 8 further comprising a grease collector cup, and a grease tube connected between said grease trap and said grease collector cup and adapted to guide accumulated waste grease from said grease trap to said grease collector cap.

11. The smoke guide structure as claimed in claim 8, wherein said inner shell and said outer shell are respectively made as a smooth arched hollow unit.

12. The smoke guide structure as claimed, in claim 8, wherein said inner shell and said outer shell are respectively formed of a plurality of metal sheet members.

* * * * *